US009306342B2

(12) United States Patent
Sellmer et al.

(10) Patent No.: US 9,306,342 B2
(45) Date of Patent: Apr. 5, 2016

(54) PLUG CONNECTION FOR THE DIRECT ELECTRICAL CONTACTING OF A CIRCUIT BOARD

(75) Inventors: Frank Sellmer, Waiblingen-Bittenfeld (DE); Ulrich Schmatz, Besigheim (DE); Michael Schoenfeld, Leinfelden-Echterdingen (DE); Hartmut Buschle, Fellbach (DE); Peter Rehbein, Thuengersheim (DE); Markus Kroeckel, Schwieberdingen (DE); Juergen Stein, Illingen (DE); Michael Fleig, Tilburg (NL)

(73) Assignee: ROBERT BOSCH GMBH, Stuttgart (DE)

( * ) Notice: Subject to any disclaimer, the term of this patent is extended or adjusted under 35 U.S.C. 154(b) by 61 days.

(21) Appl. No.: 14/114,363

(22) PCT Filed: Mar. 13, 2012

(86) PCT No.: PCT/EP2012/054390
§ 371 (c)(1),
(2), (4) Date: Jan. 15, 2014

(87) PCT Pub. No.: WO2012/146437
PCT Pub. Date: Nov. 1, 2012

(65) Prior Publication Data

US 2014/0141650 A1 May 22, 2014

(30) Foreign Application Priority Data

Apr. 29, 2011 (DE) ..... 10 2011 017 784

(51) Int. Cl.

| | |
|---|---|
| ***H01R 13/66*** | (2006.01) |
| ***H01R 13/62*** | (2006.01) |
| ***H01R 12/72*** | (2011.01) |
| ***H01R 12/50*** | (2011.01) |
| ***H01R 13/193*** | (2006.01) |

(52) U.S. Cl.
CPC ..... *H01R 13/6658* (2013.01); *H01R 12/721* (2013.01); *H01R 13/193* (2013.01); *H01R 13/62* (2013.01); *H01R 23/68* (2013.01)

(58) Field of Classification Search
CPC .... H01R 12/721; H01R 12/57; H01R 12/714; H01R 12/7076; H01R 12/716; H01R 13/53; H01R 13/193; H01R 12/88; H01R 23/68
USPC ..... 439/181, 602.2, 59, 68, 70, 259, 260, 439/263, 630, 635, 637
See application file for complete search history.

(56) References Cited

U.S. PATENT DOCUMENTS 4,838,804 A * 6/1989 Banjo et al. ..... 439/325
5,419,708 A * 5/1995 Koss et al. ..... 439/59

(Continued)

FOREIGN PATENT DOCUMENTS

| | | |
|---|---|---|
| DE | 10 2005 063239 | 6/2007 |
| EP | 0 653 818 | 5/1995 |
| JP | 2000173718 | 6/2000 |

*Primary Examiner* — Amy Cohen Johnson
*Assistant Examiner* — Oscar C Jimenez
(74) *Attorney, Agent, or Firm* — Kenyon & Kenyon LLP

(57) ABSTRACT

In a plug connection for the direct electrical contacting of contact surfaces on a circuit board, having a plug receptacle associated with the circuit board, into which the circuit board extends, having a plug pluggable into the plug receptacle, which has a contact carrier having contact elements for the direct electrical contacting of the contact surfaces of the circuit board, and having a contact pressure spring device for pressing the contact elements of the contact carrier against the contact surfaces of the circuit board, the contact pressure spring device is provided in the plug receptacle.

11 Claims, 1 Drawing Sheet

(56) References Cited

U.S. PATENT DOCUMENTS 5,573,415 A * 11/1996 Fujitani ..... H01R 12/87 439/260
6,042,410 A * 3/2000 Watanabe ..... 439/269.1
6,494,781 B2 * 12/2002 Fujita et al. ..... 439/635
7,374,460 B1 * 5/2008 Hariharesan ..... H01R 13/187 439/679
7,654,845 B2 * 2/2010 Buschle ..... H01R 12/721 439/260

* cited by examiner

PLUG CONNECTION FOR THE DIRECT ELECTRICAL CONTACTING OF A CIRCUIT BOARD

FIELD OF THE INVENTION

The present invention is based on a plug connection for the direct electrical contacting of contact surfaces on a circuit board.

BACKGROUND INFORMATION

Control units are usually made up of a circuit board, on which electronic components are placed, and a housing. In engine control units, a male multipoint connector is usually mounted on the circuit board in order to establish the electrical connection between a wire harness plug and the circuit board. The male multipoint connector thus represents an additional component in the assembly of the control unit. So-called electrical direct contacts are also known in which the male multipoint connector is omitted and the individual poles of the wire harness plug are contacted directly on the circuit board. For this purpose, electrical contact surfaces ("lands") are provided on the circuit board, which are contacted by contact elements, which are plugged into the wire harness plug.

Direct plug connections may require contact pressure reinforcement for the plug connection when contacting the contacts on the circuit board unilaterally. This contact pressure reinforcement acts against the sum of the normal contact forces exerted by electrical contact elements of the plug on the contact surfaces. Currently implemented design approaches provide spring elements for this purpose, which are component parts of the wire harness plug. It is believed that this may entail the following disadvantages, however:

- The functional component "contact pressure reinforcement for the wire harness plug" has an unfavorable effect on a reduction of the size of the wire harness plug.
- Existing design approaches display an application of force on the structure of the wire harness plug that is not easy to optimize in practice. Since wire harness plugs are normally made of plastic and are therefore subject to a permanent flow behavior as a function of temperature and stress, this aspect cannot be ignored.
- Existing design approaches have spring elements that already require a pretensioned contact pressure spring even in the case of a wire harness plug that has not been contacted. This has an unfavorable effect on the dimensioning of the spring.
- Existing design approaches have layouts that require spring expansions that run counter to the expansions necessary in the event of a load (i.e. when the wire harness plug is plugged). This has an unfavorable effect on the dimensioning of the contact pressure spring and the plug-in force.
- Existing design approaches have layouts, which, when applying the contact pressure force via the contact pressure spring, produce opposing forces or moments that counteract the actual contact pressure force.

SUMMARY OF THE INVENTION

An objective of the present invention is to develop a plug connection of the species in such a way that a plug-side contact pressure spring may be omitted and the miniaturization of the plug may be increased further.

This objective is attained according to the present invention by plug connection having the features set forth herein.

In contrast to other approaches, the functional component "contact pressure reinforcement for the wire harness plug" according to the present invention is not accommodated in the wire harness plug, but is rather a component part of the plug receptacle (interface), which may be embodied by a plug shroud or a plug box.

The omission, according to the present invention, of the "contact pressure reinforcement" hitherto provided on the plug yields in particular the following advantages:

- The miniaturization of the plug may be increased.
- The application of force on the structure of the plug may be optimized.
- No pretensioning of the contact pressure spring situated in the circuit board-side or interface-side plug receptacle is necessary.
- The spring travel of the contact pressure spring may be optimized to the minimum necessary for the contact pressure application.
- In the ideal case, the contact pressure may be applied onto the plug directly in the area just above the contact as a knife-edge load. Opposing forces or moments are thus avoided.

The force buildup by the spring elements positioned in the plug receptacle occurs only at the very end of the plugging process. The plugging process may thus occur over a long travel path nearly without applying force. This fundamentally reduces the danger of damage to contact elements by the circuit board and its contact surfaces and facilitates the formation of the plug connection during the plugging process since the latter occurs in a region in which the contact pressure is not yet active.

Further advantages and advantageous developments of the subject matter of the present invention are derivable from the description, the drawings and the further disclosure herein.

The present invention will be explained in greater detail below with reference to several exemplary embodiments reproduced in exemplary form in the drawings.

DETAILED DESCRIPTION

Figure 1A:
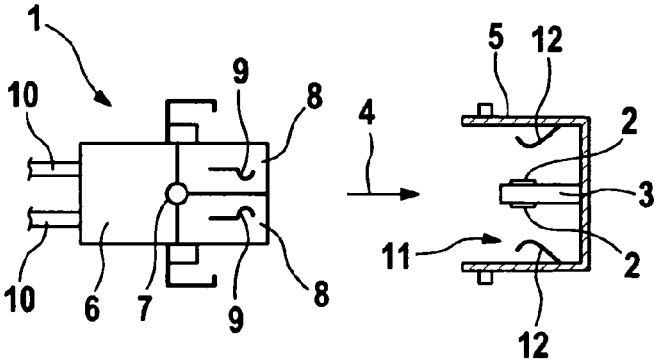
FIG. 1*a* shows the plug connection according to the present invention in the still unplugged state, in a side view.
Figure 1B:
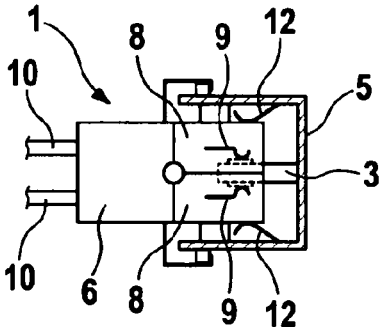
FIG. 1*b* shows the plug connection according to the present invention in the plugged state, in a side view.

The plug connection shown in FIGS. 1*a*, 1*b* is configured for the direct electrical contacting of contact surfaces ("lands") 2 on a circuit board 3 also referred to as a "control unit", it being possible for the contact surfaces 2 to be provided on one or on both side(s) of circuit board 3.

A plug receptacle 5 of a plug shroud or a plug box, which is open in a plugging direction 4, is provided on circuit board 3, into which circuit board 3 extends in the area of its contact surfaces 2 against plugging direction 4. A plug (e.g. a wire harness plug) 6 is plugged into plug receptacle 5 in plugging direction 4, which has two contact carrier halves 8 that are connected to each other in a hinged manner at location 7. As shown in FIG. 1*b*, circuit board 3 is plugged in between the two contact carrier halves 8, which in the process electrically contact the contact surfaces 2 of circuit board 3 by their springy contact elements 9. The electric lines of wire harness plug 6 leading to contact elements 9 are indicated by reference numeral 10.

A contact pressure spring device 11 in the form of contact pressure springs 12 is provided in plug receptacle 5, which are situated in plug receptacle 5 on both sides of circuit board 3 and engage in the plug path of the two contact carrier halves 8. These contact pressure springs 12 tension the two contact carrier halves 8 of the plugged wire harness plug 6 towards each other, whereby their contact elements 9 are pressed with a corresponding contact pressure force against contact surfaces 2 of circuit board 3. The buildup of the contact pressure force thus occurs via the plug shroud (counter bearing) that forms plug receptacle 5 and via contact pressure springs 12 onto contact carrier halves 8 and their contact elements 9. Advantageously, contact pressure springs 12 are situated at the level of contact elements 9 of plugged wire harness plug 6 so that the contact pressure force may be applied directly onto contact carrier halves 8 in the area just above contact elements 9 as a knife-edge load.

Figure 2:
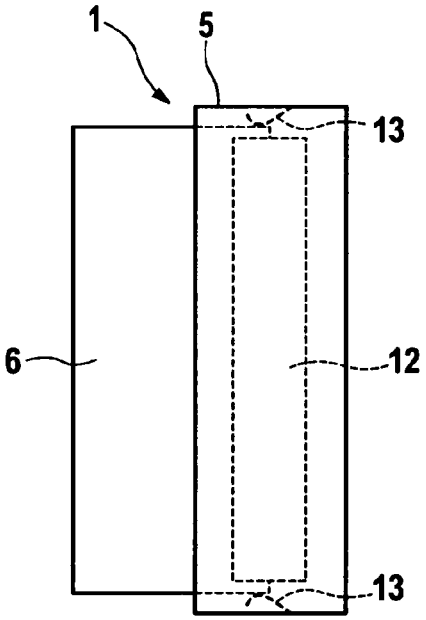
FIG. 2 shows a top view of the plug connection according to the present invention shown in FIG. 1*b* having a contact pressure spring extending across the entire width of the plug.

As shown in FIG. 2, a single contact pressure spring 12 may be provided, which for a knife-edge-shaped application of force extends nearly over the entire width of plug receptacle 5.

Figure 3:
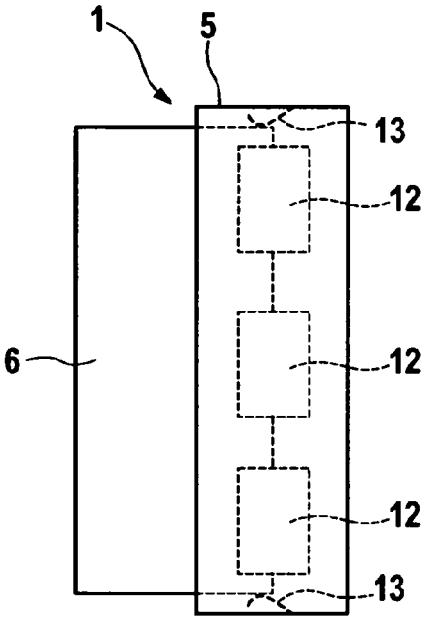
FIG. 3 shows a top view of the plug connection according to the present invention shown in FIG. 1*b* having multiple contact pressure springs situated along the entire width of the plug.

Alternatively, as shown in FIG. 3, it is also possible to provide multiple contact pressure springs 12, which are arranged side-by-side along the width of plug receptacle 5 for a knife-edge-shaped application of force.

In order to increase the reliability of plug connection 1, tension springs 13 are respectively provided in plug receptacle 5 laterally next to the two lateral edges of circuit board 3 extending into plug receptacle 5, which tension springs 13 brace plugged wire harness plug 6 within plug receptacle 5 perpendicularly to the contact pressure force exerted by contact pressure springs 12.

What is claimed is:

1. A plug connection for direct electrical contacting of contact surfaces on a circuit board, comprising:

a plug receptacle: (i) associated with the circuit board, into which the circuit board extends and (ii) having at least two contact pressure springs; and a plug pluggable into the plug receptacle, which has a contact carrier having contact carrier halves, each contact carrier halve having at least one spring contact element, wherein when the plug is plugged in the plug receptacle:

the at least two contact pressure springs tension the contact carrier halves of the plug, and based on the tensioned contact carrier halves of the plug, each at least one spring contact element exerts a force that provides electrical contact with the contact surfaces of the circuit board.

2. The plug connection of claim 1, wherein the at least one of the at least two contact pressure springs is provided on each side of the circuit board extending into the plug receptacle.

3. The plug connection of claim 1, wherein each of the at least two contact pressure springs extend over nearly the entire width of the plug receptacle.

4. The plug connection of claim 1, wherein each of the at least two contact pressure springs is situated at the level of the spring contact elements of the plugged plug.

5. The plug connection of claim 1, wherein the at least two contact pressure springs form a contact pressure spring device, which engages into the plug path of the contact carrier.

6. The plug connection of claim 5, wherein the contact pressure spring device extends over nearly the entire width of the plug receptacle.

7. The plug connection of claim 1, wherein multiple contact pressure springs from the at least two contact pressure springs are provided along the width of the plug receptacle.

8. The plug connection of claim 5, wherein the two contact carrier halves are connected to each other in a hinged manner, between which the circuit board is provided, and wherein the contact pressure spring device presses the two contact carrier halves and the spring contact elements against the contact surfaces of the circuit board.

9. The plug connection of claim 1, wherein respectively one tension spring is provided in the plug receptacle respectively laterally next to two lateral edges of the circuit board extending into the plug receptacle, which tension spring engages into the plug path of the plug and braces the plugged plug within the plug receptacle perpendicularly to the force exerted by each at least one spring contact element.

10. The plug connection of claim 1, wherein the force exerted by each at least one spring contact element corresponds to a tension force from the tensioned contact carrier halves of the plug.

11. The plug connection of claim 1, wherein each of the at least two contact pressure springs provide a tension force directly onto each of the contact carrier halves on an area directly above the at least one spring contact element as a knife-edge load.

* * * * *